US008844735B1

(12) United States Patent
Selby

(10) Patent No.: US 8,844,735 B1
(45) Date of Patent: Sep. 30, 2014

(54) DISPLAY RACK

(76) Inventor: William J. Selby, Stoughton, MA (US)

( * ) Notice: Subject to any disclaimer, the term of this patent is extended or adjusted under 35 U.S.C. 154(b) by 211 days.

(21) Appl. No.: 13/572,959

(22) Filed: Aug. 13, 2012

Related U.S. Application Data

(63) Continuation-in-part of application No. 12/964,809, filed on Dec. 10, 2010, now Pat. No. 8,262,014, which is a continuation-in-part of application No. 12/786,715, filed on May 25, 2010, now Pat. No. 8,210,464.

(51) Int. Cl.

| | |
|---|---|
| ***A47F 7/00*** | (2006.01) |
| ***A47F 1/04*** | (2006.01) |
| ***A47F 5/14*** | (2006.01) |
| ***A47G 29/00*** | (2006.01) |
| ***A47F 5/00*** | (2006.01) |
| ***A47F 7/17*** | (2006.01) |
| ***A47F 1/12*** | (2006.01) |
| ***A47F 5/01*** | (2006.01) |
| ***A47F 1/08*** | (2006.01) |
| ***B65H 49/32*** | (2006.01) |
| ***B65D 85/04*** | (2006.01) |
| ***A47B 55/02*** | (2006.01) |
| ***A47B 81/00*** | (2006.01) |

(52) U.S. Cl.

CPC ..... *A47F 5/0025* (2013.01); *A47F 7/17* (2013.01); *A47F 1/121* (2013.01); *A47F 5/01* (2013.01); *A47F 1/082* (2013.01); *B65H 49/322* (2013.01); *B65D 85/04* (2013.01); *A47B 55/02* (2013.01); *A47B 81/007* (2013.01)

USPC ..... 211/85.17; 211/181.1; 211/59.2

(58) Field of Classification Search

CPC ..... B65H 49/32; B65H 57/18; B65H 49/322; B65H 57/00; B62H 3/12; B62H 3/04; B62H 3/08; B62H 3/00; A47F 5/14; A47F 5/01; A47F 1/12; A47F 5/135; A47F 7/148; A47F 5/0025; A47F 7/16; A47F 7/17; A47F 5/0018; A47F 5/0031; A47F 3/14; A47F 5/13; A47F 1/082; A47F 5/0056; B65D 85/04; B65D 85/00; B65D 85/66; B65D 85/671; B65D 85/672; A47B 81/00; A47B 65/00; A47B 81/067; A47B 87/02; A47B 81/001; A47B 73/002; A47B 55/02; B62B 3/006; B62B 1/264

USPC ..... 211/42, 41.14, 41.15, 41.16, 26.2, 211/41.11, 85.19, 85.17, 184, 22, 10, 27, 211/59.4, 181.1, 85.31, 59.2, 119.003

See application file for complete search history.

(56) References Cited

U.S. PATENT DOCUMENTS

D32,181 S * 1/1900 Pease ..... D12/115
D36,091 S * 9/1902 Merritt ..... D12/115

(Continued)

*Primary Examiner* — Jennifer E Novosad
(74) *Attorney, Agent, or Firm* — Steven N. Fox, Esq.

(57) ABSTRACT

A display rack mountable on a shelf of a store for showcasing first and second display boxes and wound flexible tubing. The display rack comprises front and rear support members. The display rack further comprises first, second, and third open sidewall support members each having a first end engaged with the front support member and a second end engaged with the rear support member. The display rack further comprises a first stall formed between the first and second open sidewall support members. The first stall is adapted to receive the first display box. The display rack further comprises a second stall formed between the second and third open sidewall support members. The second stall is adapted to receive the second display box. The front and rear support members support the front and rear portions of the first and second display boxes, respectively.

15 Claims, 15 Drawing Sheets

(56) References Cited

U.S. PATENT DOCUMENTS

| | | | | | |
|---|---|---|---|---|---|
| 2,635,762 | A | * | 4/1953 | Shaw | 211/85.17 |
| 3,176,848 | A | * | 4/1965 | Stefan | 211/40 |
| 3,195,732 | A | * | 7/1965 | Schwartz | 211/40 |
| 3,225,939 | A | * | 12/1965 | Braun | 211/186 |
| 3,800,958 | A | * | 4/1974 | Dorn | 211/43 |
| 3,918,588 | A | * | 11/1975 | Walser et al. | 211/49.1 |
| 4,128,177 | A | * | 12/1978 | Bustos | 211/59.2 |
| 4,433,787 | A | * | 2/1984 | Cook et al. | 211/5 |
| 5,074,420 | A | * | 12/1991 | Cappel, III | 211/42 |
| 5,096,068 | A | * | 3/1992 | Theriault | 211/22 |
| 5,111,940 | A | * | 5/1992 | VanNoord | 211/40 |
| 5,238,125 | A | * | 8/1993 | Smith | 211/5 |
| 5,240,124 | A | * | 8/1993 | Buday | 211/59.2 |
| D343,075 | S | * | 1/1994 | Cappel, III | D6/462 |
| 5,788,092 | A | * | 8/1998 | Teeney | 211/70.6 |
| 5,826,817 | A | * | 10/1998 | Selby | 242/588.6 |
| 6,328,170 | B1 | * | 12/2001 | Lee | 211/59.2 |
| 6,419,096 | B1 | * | 7/2002 | Shepherd | 211/18 |
| 6,719,151 | B2 | * | 4/2004 | Close | 211/59.3 |
| 6,837,387 | B2 | * | 1/2005 | De La Fuente | 211/181.1 |
| 8,210,464 | B1 | * | 7/2012 | Selby | 242/615.4 |
| 2007/0125734 | A1 | * | 6/2007 | Chang | 211/181.1 |
| 2008/0314846 | A1 | * | 12/2008 | Klein et al. | 211/41.11 |

* cited by examiner

DISPLAY RACK

CROSS-REFERENCE TO RELATED APPLICATIONS

This application claims priority to and is a continuation-in-part of application Ser. No. 12/964,809 filed on Dec. 10, 2010, now pending, which is a continuation-in-part of application Ser. No. 12/786,715 filed on May 25, 2010, now U.S. Pat. No. 8,210,464, both of which are hereby incorporated by reference in their entirety into this specification.

BACKGROUND OF THE INVENTION

U.S. Pat. No. 5,826,817 discloses a box for storing, displaying, and dispensing flexible tubing or other items that can be wound upon a spool such as ropes or chains. Such conventional boxes are mounted directly on a shelf of a retailer's store. Conventional boxes of this type have enjoyed wide commercial success but are not without drawbacks. For example, the product contained in the box is not substantially visible to the consumer. A consumer must look thru a window to determine what type of product is contained in the box. Further, the box has edges that may cut a person's finger's when the product is removed from the box. Further, the box may move side-to-side or back-to-front as a customer unwinds the product from the box. Movement of one box may also cause adjacent boxes to move thereby rendering the entire shelf unattractive to consumers. The retailer must then re-align the boxes to make the shelf space attractive. Further, the box is made from cardboard. As such, the sidewalls of the box tend to become worn as the product is dispensed. Still further, the box uses a substantial amount of cardboard material which increases the overall cost of the box.

SUMMARY OF THE INVENTION

One object of the present invention is to provide a display box that allows a consumer to easily view and examine the product contained therein.

Another object of the present invention to provide a display rack for showcasing multiple display boxes (and the products therein) on a store shelf of a retail store.

Still another object of the present invention is to provide a display rack for showcasing multiple display boxes which reduces the movement of the display boxes thereby saving a retailer time in re-aligning or otherwise fixing the shelf space.

The present invention is a display rack mountable on a shelf of a retail store for showcasing first and second display boxes having front and rear portions. The display rack comprises front and rear support members and a first open sidewall support member having a first end engaged with the front support member and a second end engaged with the rear support member. The display rack further comprises a second open sidewall support member having a first end engaged with the front support member and a second end engaged with the rear support member. The display rack further comprises a third open sidewall support member having a first end engaged with the front support member and a second end engaged with the rear support member. The display rack further comprises a first stall or bin formed between the first and second open sidewall support members. The first stall is adapted to receive the first display box. The front and rear support members are adapted to support the front and rear portions of the first display box, respectively. The display rack further comprises a second stall formed between the second and third open sidewall support members. The second stall is adapted to receive the second display box. The front and rear support members are adapted to support the front and rear portions of the second display box, respectively. The display rack of the present invention provides a cost effective way of showcasing multiple display boxes and the products contained therein to consumers while reducing the amount of time a retailer spends cleaning up or otherwise reorganizing the shelf space.

BRIEF DESCRIPTION OF THE DRAWINGS

The following description of the invention will be described with reference to the accompanying drawings in which.

DESCRIPTION OF INVENTION

Figure 1:
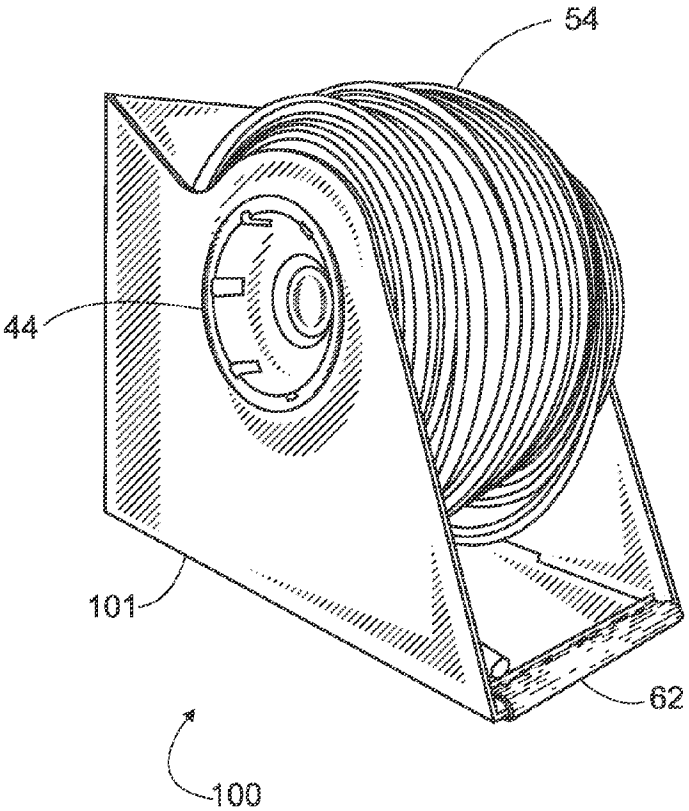
FIG. 1 is a perspective view of a display box according to a first embodiment of the present invention with flexible tubing fully wound upon a spool assembly.

Referring to FIG. 1, the present invention is a display box or device 100 for storing, displaying, and dispensing articles such as flexible tubing 54 on a retail store self (not shown).

Display box 100 generally comprises a one-piece housing 101, a spool assembly 44, flexible tubing 54 wound upon a spool assembly 44, and a bumper 62.

Figure 2:
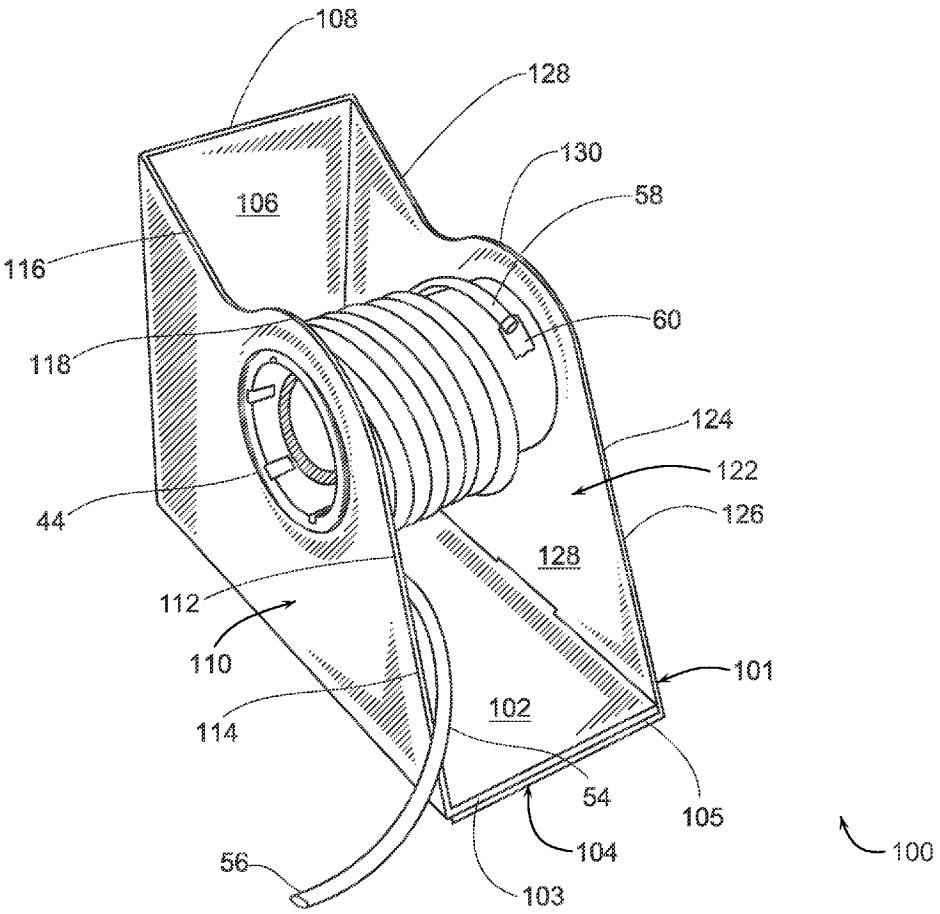
FIG. 2 is a perspective view of the display box of the first embodiment shown with the flexible tubing substantially dispensed.

Referring to FIG. 2, one-piece housing 101 generally comprises an inner bottom wall 102, an outer bottom wall 104, a rear wall 106, a first side wall 110, a second side wall 122, and a rear wall 106. Inner and outer bottom walls 102 and 104 comprise a front edge 103 and a front edge 105, respectively. Rear wall 106 comprises an outside edge 108. First and second sidewalls 110 and 122 further comprise outside edges 112 and 124, respectively. First and second sidewalls 110 and 122 extend upward from inner and outer bottom walls 102 and 104, respectively, and are substantially perpendicular to rear wall 106. Outside edge 112 of first sidewall 110 comprises a leading straight edge 114, a trailing straight edge 116, and a curved edge 118. Curved edge 118 is disposed between leading and trailing straight edges 114 and 116. Outside edge 124 of second sidewall 122 comprises a leading straight edge 126, a trailing straight edge 128 and a curved edge 130. Curved edge 130 is disposed between leading and trailing straight edges 126 and 128. As will be described more fully herein, one-piece housing 101 is fabricated from a sheet of cardboard (FIG. 6) by conventional cutting, folding, and stapling operations.

Figure 3:
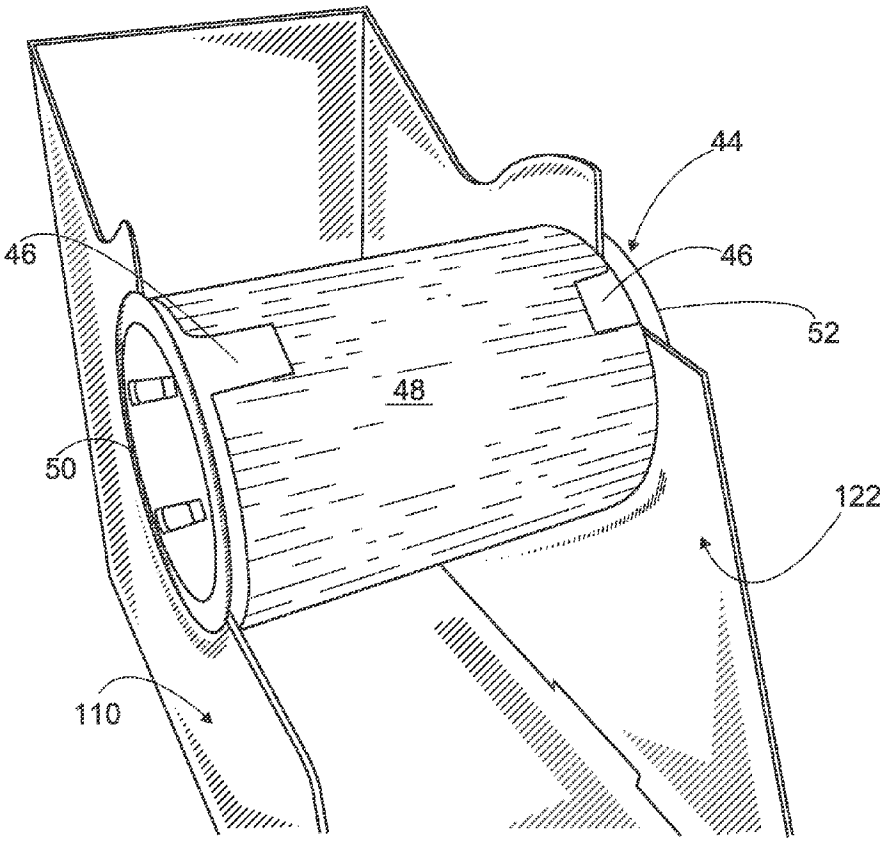
FIG. 3 is a perspective view of the display box of the first embodiment wherein the left and right sidewalls are partially cut away to show the spool assembly.

Referring to FIG. 3, spool assembly 44 comprises an inner spool 46, an outer spool 48, a left flange 50 and a right flange 52. Left and right flanges 50 and 52 are engaged with open ends (not shown) of inner spool 46 thru openings 120 and 132 (FIG. 6) of first and second sidewalls 110 and 122, respectively. Outer spool 48 freely rotates about inner spool 46.

Referring back to FIGS. 1 and 2, flexible tubing 54 is wrapped about outer spool 48 toward a substantially radial position outward of leading and trailing straight edges 114 and 116 of first sidewall 110 and leading and trailing straight edges 126 and 128 of second sidewall 122. Flexible tubing 54 further comprises an inside end 58 and an outside end 56. Inside end 58 is attached to spool assembly 44 by a fastener 60. In the embodiment shown, fastener 60 is a conventional piece of adhesive tape. In other embodiments, fastener 60 may be staples or any other well-known type of fastener.

Figure 4:
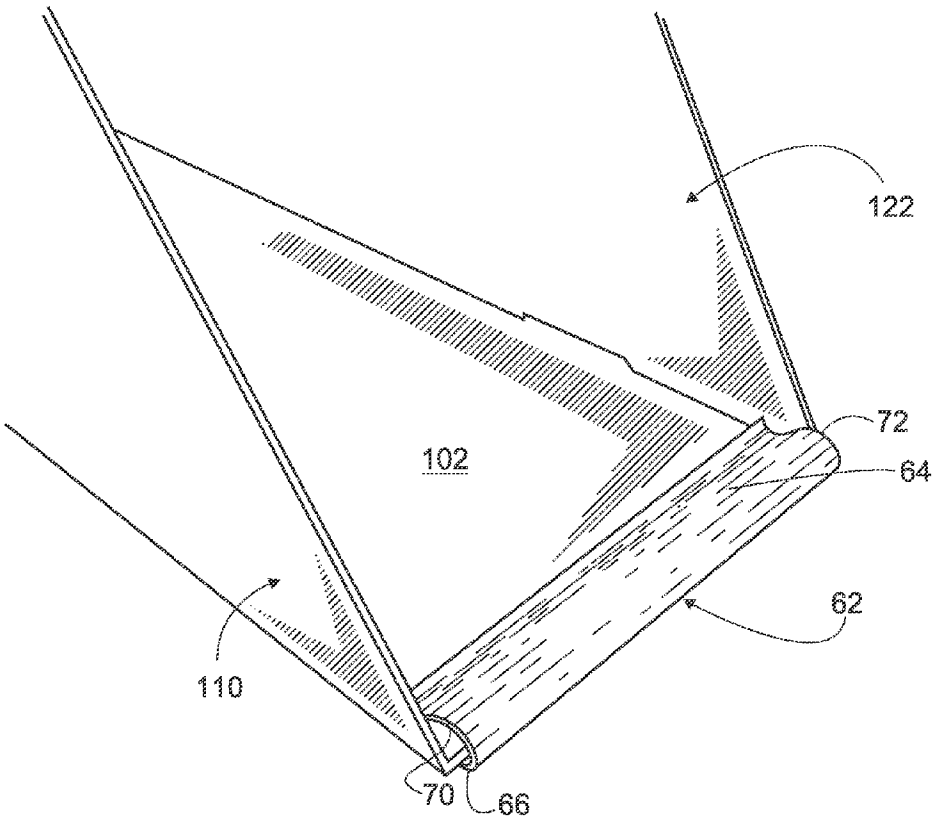
FIG. 4 is a perspective view of the display box of the first embodiment showing a bumper engaged with a front edge of a bottom wall of the display box.
Figure 5:
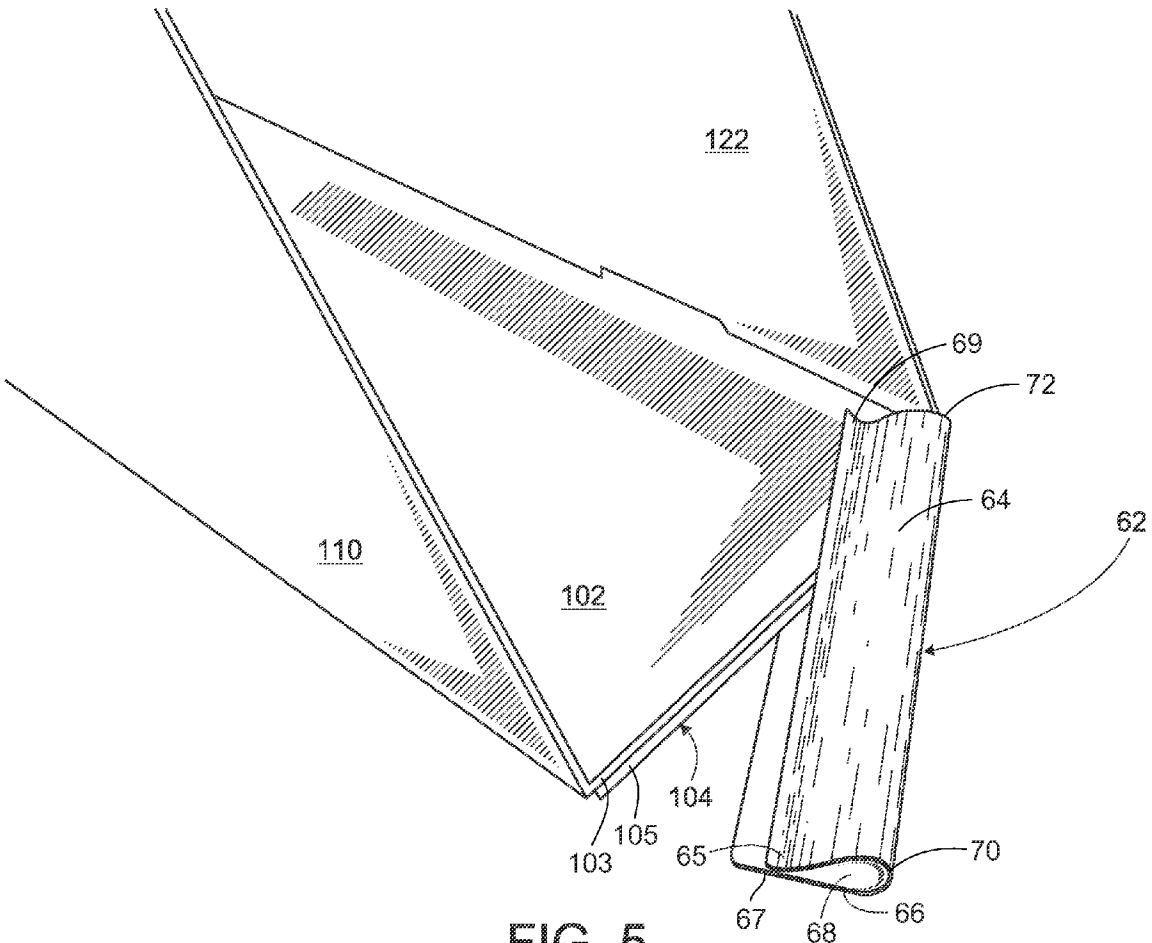
FIG. 5 is a perspective view of the display box of the first embodiment showing the bumper partially removed from the front edge of the bottom wall.

Referring to FIGS. 4 and 5, display box 100 further comprises a bumper 62 engaged with front edge 103 and front edge 105 of inner and outer bottom walls 102 and 104, respectively. Bumper 62 extends along front edge 103 and lower front edge 105 of inner bottom wall 102 and outer bottom wall 104, respectively, from substantially first sidewall 110 to second sidewall 122. Bumper 62 is made from a flexible material such as, but not limited to, rubber or plastic or any combination thereof. Bumper 62 further comprises an upper wall 64 having an end portion 65. Bumper 62 further comprises a lower wall 66 having an end portion 67 terminating in an upwardly extending lip portion 69. End portion 65 is formed so as to be in biased or spring loaded contact with end portion 67. Bumper 62 further comprises a channel 68, a first end 70, and a second end 72. As shown by FIG. 5, lip portion 69 of bumper 62 engages with front edge 103 of inner bottom wall 102 which urges end portion 65 upward so that bumper 62 may slide into full engagement over front edges 103 and 105 of inner and outer sidewalls 102 and 104, respectively, between upper and lower walls 64 and 66 of bumper 62. Bumper 62 provides frictional support to display box 100 against the pulling force applied by a customer when dispensing flexible tubing 54. Bumper 62 also prevents a consumer from contacting front edges 103 and 105 of inner and outer bottom walls 102 and wall 104, respectively, thereby preventing any cuts to the consumer's finger. Bumper 62 also prevents damage to front edges 103 and 105 of inner and outer bottom walls 102 and 104, respectively. Bumper 62 may take different forms. By way of example only, bumper 62 may employ multiple pieces engaged with front edges 103 and 105 rather than one-piece.

Display box 100 may employ products other than flexible tubing 54. By way of example only, display box 100 may employ a rope, a chain, a wire or wall paper, or any other elongated flexible product suited for dispensing from a spool.

Figure 6:
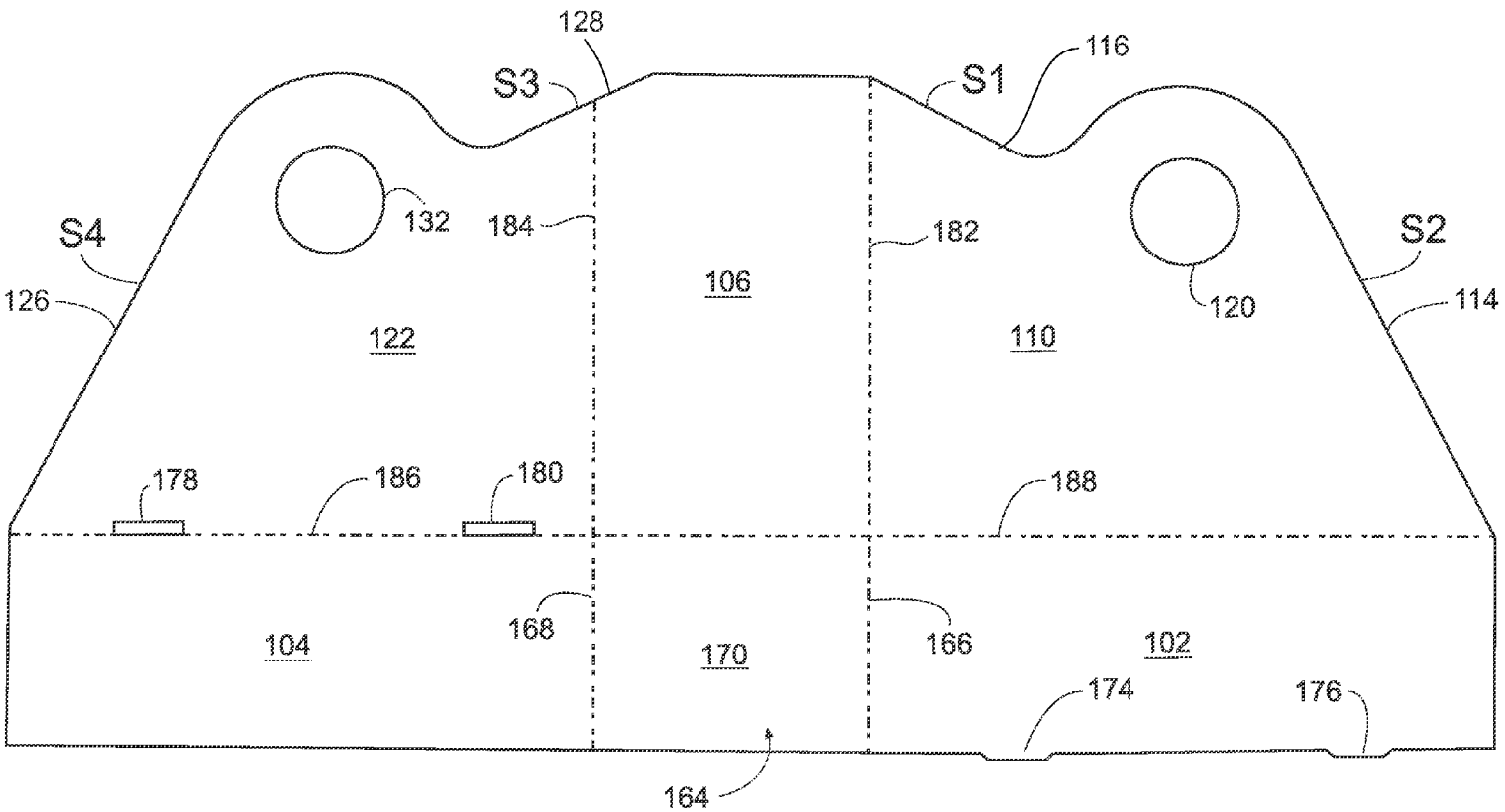
FIG. 6 is a top plan view of a cardboard sheet showing various cut and fold lines to form the one-piece housing of the display box of the first embodiment.

Referring to FIG. 6, one-piece housing 101 is fabricated from a single cardboard sheet 164 having various cut-lines and fold lines that allow sheet 164 to be folded to the desired shape. Sheet 164 comprises a cut line 166, a cut line 168, a rear wall flap 170, inner bottom wall 102, outer bottom wall 104, a first tab 174, and a second tab 176 extending outward from inner bottom wall 102. Sheet 164 further comprises a first vertical fold line 182, a second vertical fold line 184, a first horizontal fold line 186 and a second horizontal fold line 188. Sheet 164 further comprises a first slot 178 and a second slot 180 cut in second sidewall 122 and extending from horizontal fold line 186. Sheet 164 further comprises openings 120 and 132 that are cut into sidewalls 110 and 122, respectively. One-piece housing 101 is formed by pre-folding cardboard sheet 164 along fold lines 182, 184, 186, and 188. After pre-folding, cuts are made along cut lines 166 and 168. After cutting, sheet 164 is folded along fold lines 182, 184, 186, and 188. Inner bottom wall 102 is then folded above outer bottom wall 104 and tabs 174 and 176 are inserted into slots 180 and 178, respectively. Leading straight edge 114 of first sidewall 110 has a slope S2 and trailing straight edge 116 of first sidewall 122 has a slope S1. Slope S2 is larger than slope S1. Leading straight edge 126 of second sidewall 122 has a slope S4. Trailing straight edge 128 of second sidewall 122 has a slope S3. Slope S4 is larger than slope S3. The sloped walls of display box 100 reduce the consumption of material and overall cost. The sloped walls of display box 100 further provide structural stability during dispensing.

Figure 7:
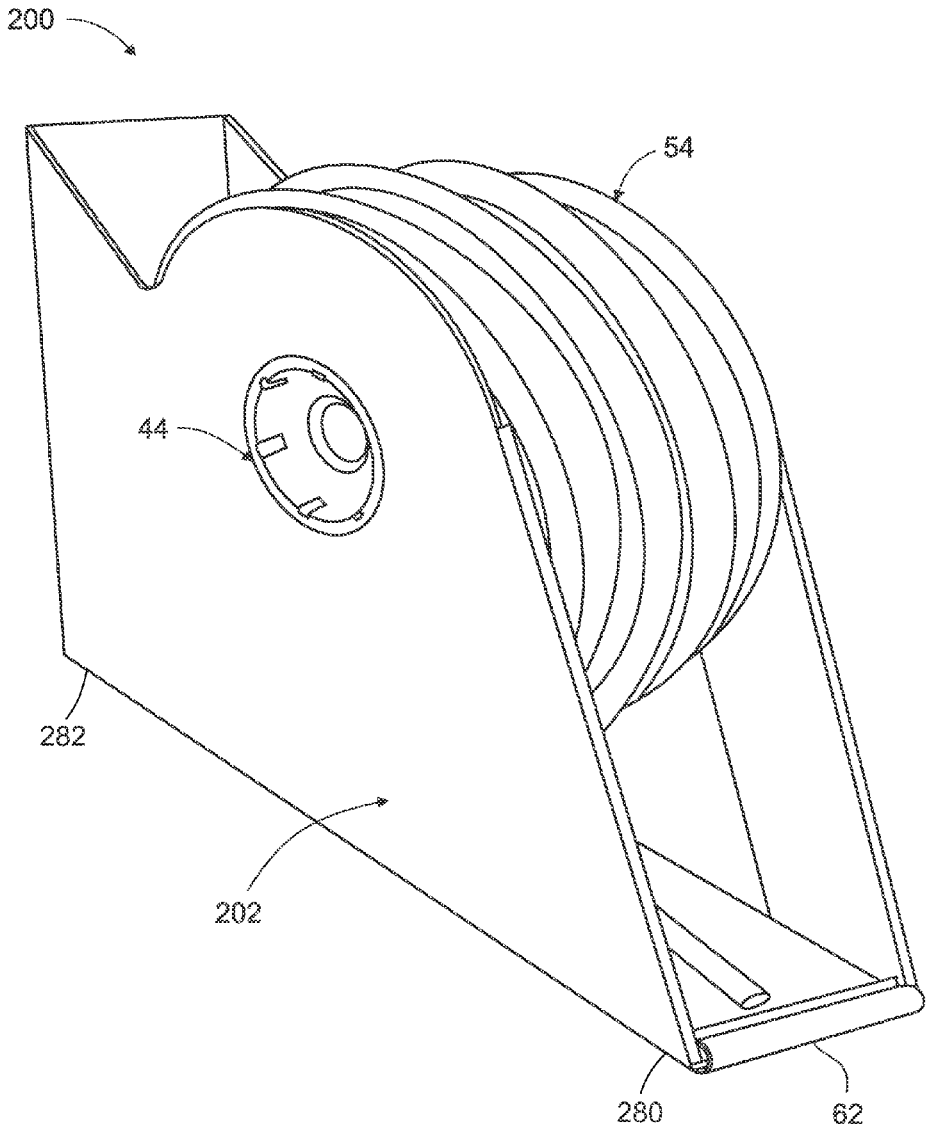
FIG. 7 is a perspective view of a display box according to a second embodiment of the present invention with flexible tubing fully wound thereon and left and front sidewalls having smooth leading walls.

Referring to FIG. 7, a device or display box 200 according to a second embodiment of the present invention generally comprises a one-piece housing 202, a spool assembly 44, a flexible tubing 54 wound upon a spool assembly 44, and a bumper 62. Spool assembly 44, flexible tubing 54, and bumper 62 have been described in connection with display box 100 (FIGS. 1-5).

Figure 8:
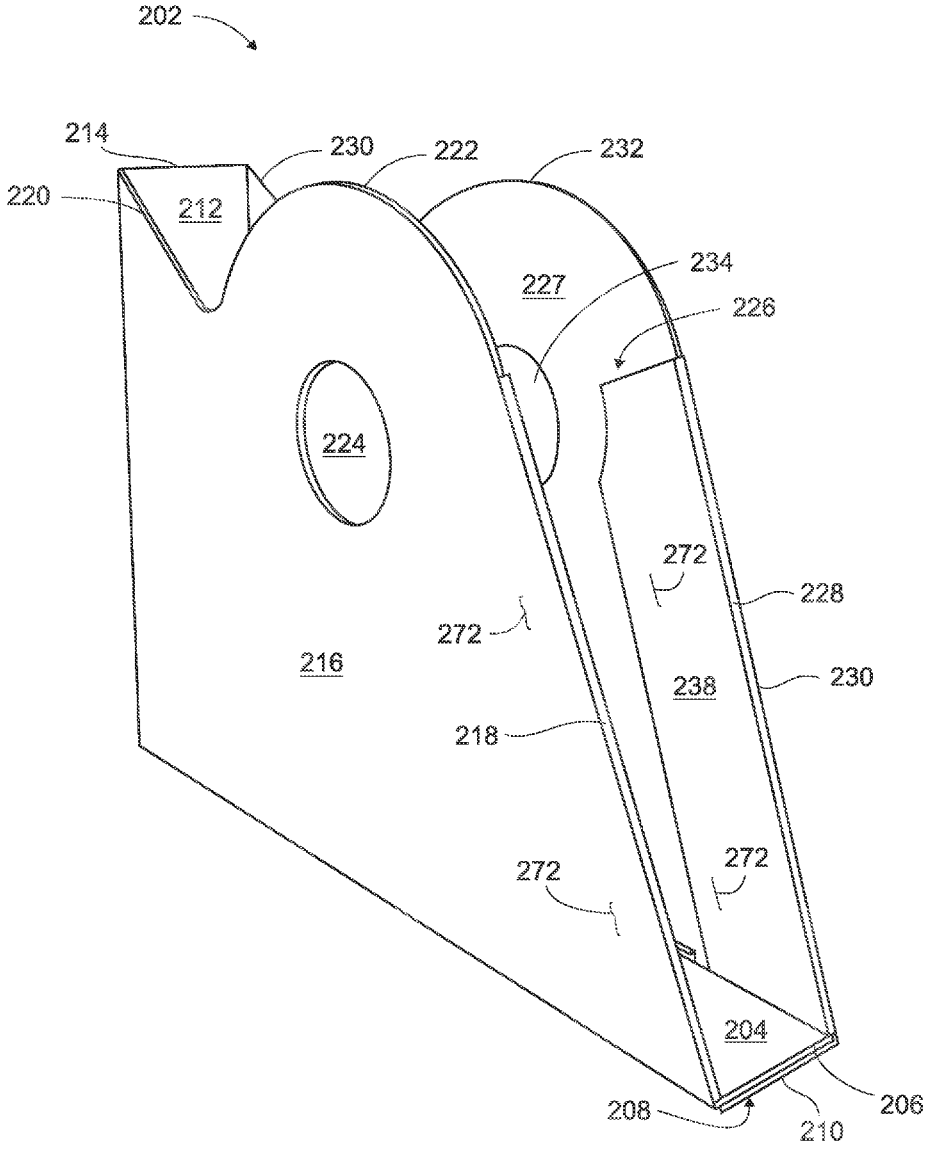
FIG. 8 is a perspective view of an assembled one-piece housing of the display box according to the second embodiment.
Figure 9:
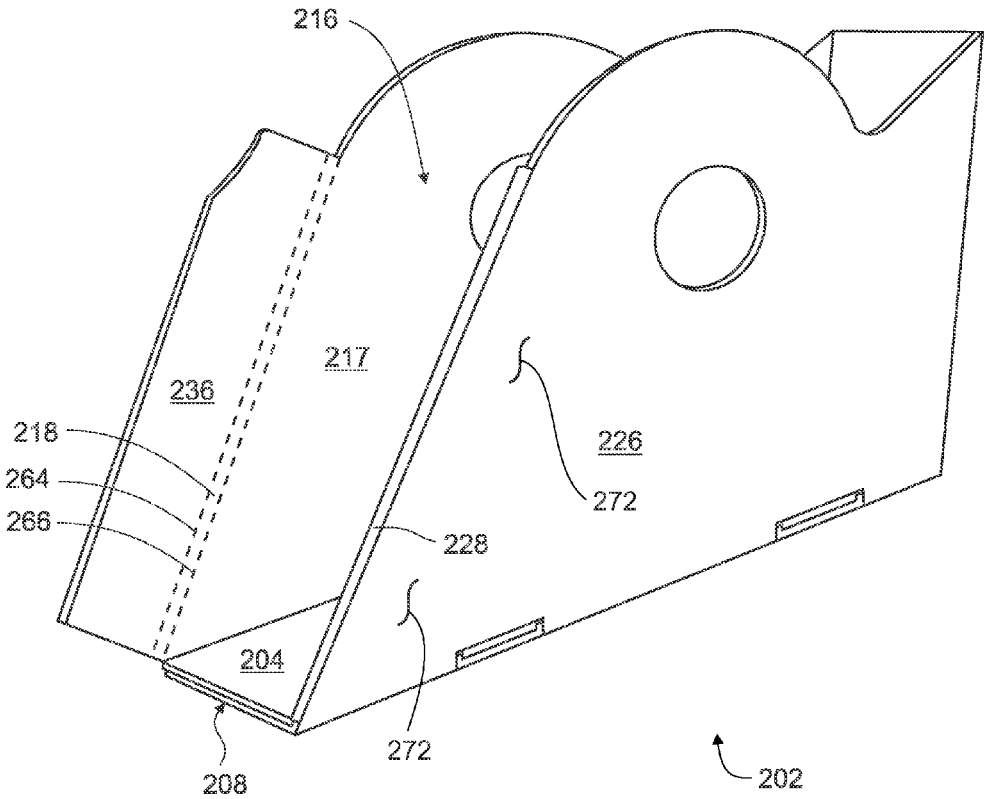
FIG. 9 is a perspective view of the one-piece housing according to the second embodiment showing a left or first flap in an open position extending from a front portion of the first sidewall of the one-piece housing.
Figure 10:
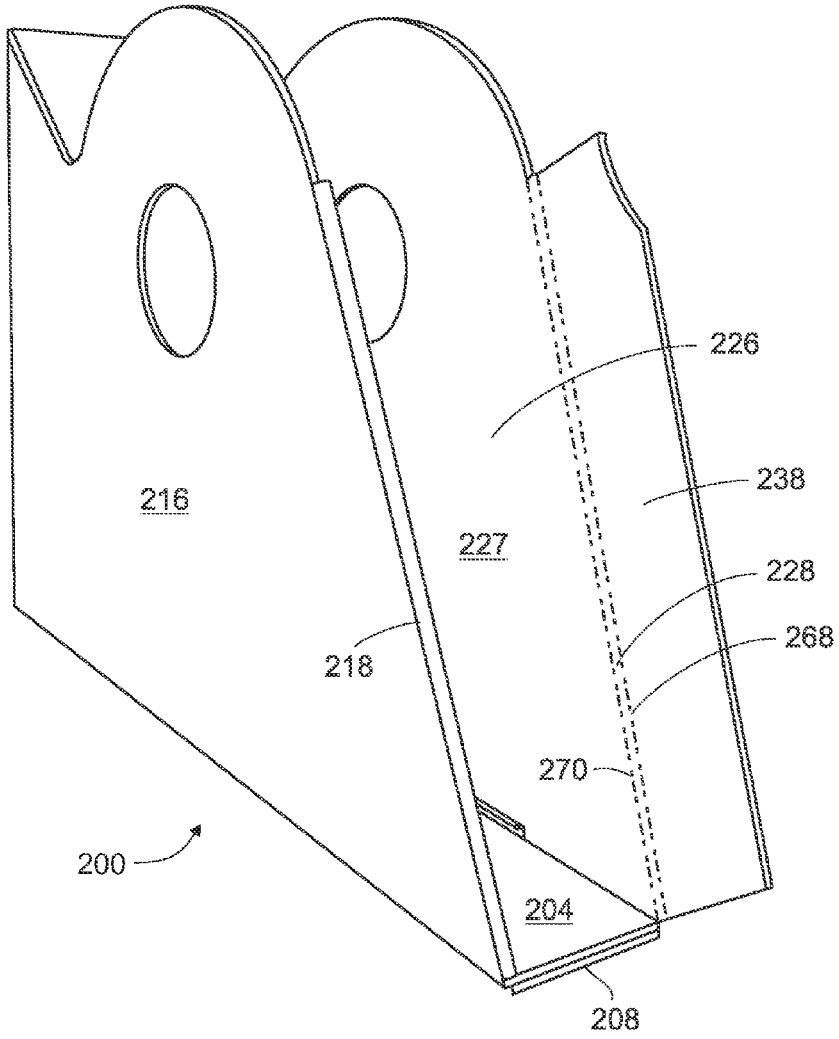
FIG. 10 is a perspective view of the one-piece housing according to the second embodiment showing a right or second flap in an open position extending from a front portion of the second sidewall of the one-piece housing.

Referring to FIGS. 8-10, one-piece housing 202 generally comprises an inner bottom wall 204, an outer bottom wall 208, a rear wall 212, a first sidewall 216, and a second sidewall 226. Inner and outer bottom walls 204 and 208 comprise front edges 206 and 210, respectively. Rear wall 212 comprises an outside edge 214. First and second sidewalls 216 and 226 extend upward from bottom walls 204 and 208, respectively, and are substantially perpendicular to rear wall 212. First sidewall 216 comprises a smooth leading wall 218, a trailing straight edge 220, and a curved edge 222. Curved edge 222 is disposed between smooth leading wall 218 and trailing straight edge 220. Second sidewall 226 comprises a smooth leading wall 228, a trailing straight edge 230, and a curved edge 232. Curved edge 232 is disposed between smooth leading wall 228 and trailing straight edge 230. Smooth leading walls 218 and 228 substantially reduce the likelihood of a customer obtaining a paper-cut while dispensing flexible tubing 54.

Referring to FIGS. 9-10, smooth leading wall 218 is formed by a flap 236 that is folded upon inside surface 217 of first sidewall 216 (FIG. 9). Smooth leading wall 220 is formed by a flap 238 that is folded upon inside surface 227 of second sidewall 226 (FIG. 10). Flaps 236 and 238 are securely attached to first and second sidewalls 216 and 226 by conventional means such as staples 272. One-piece housing 202 further comprises openings 224 and 234 to receive spool assembly 44 as described in connection display box 100 of the first embodiment (FIGS. 2-3).

Figure 11:
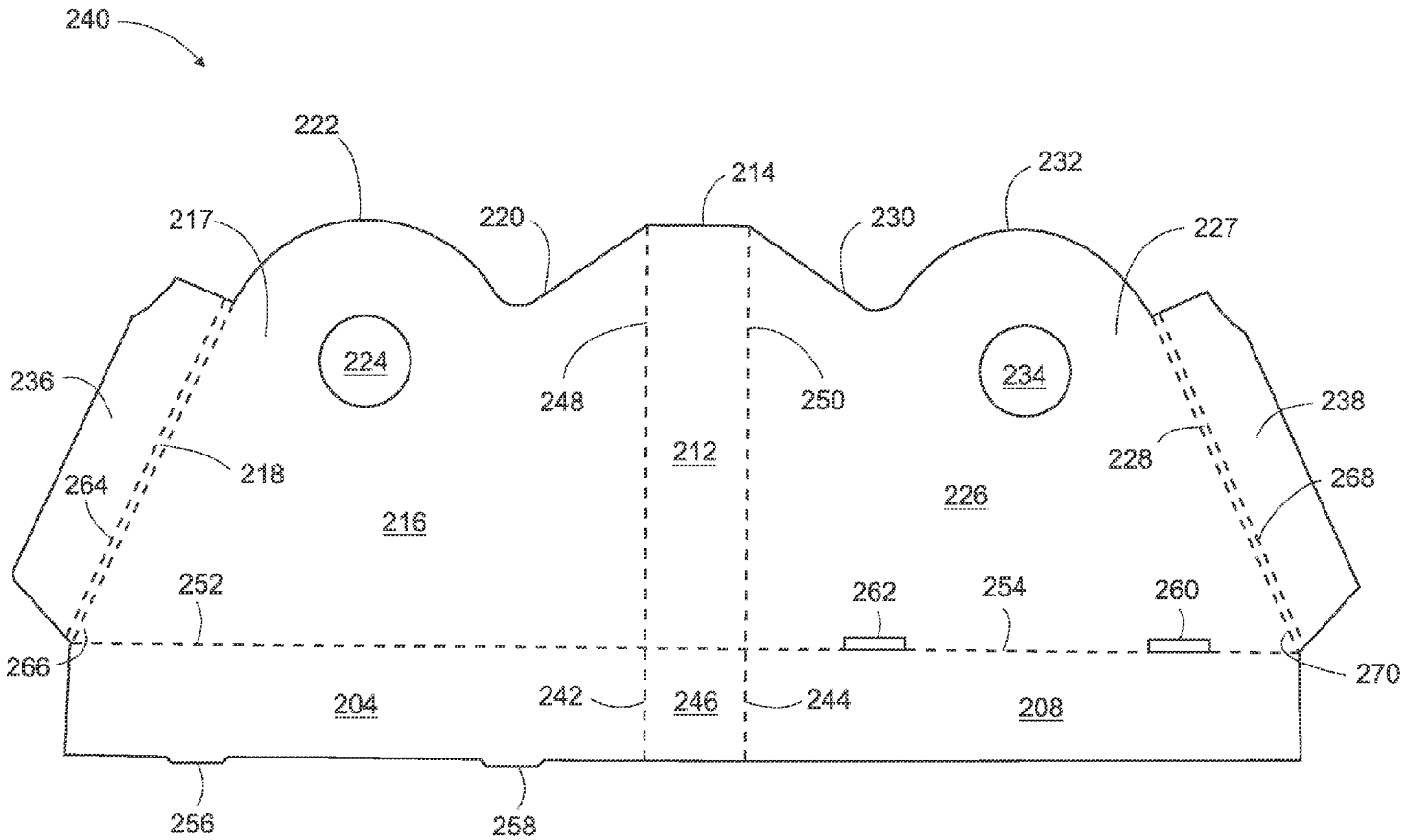
FIG. 11 is a top plan view of a cardboard sheet showing various cut and fold lines to form the one-piece housing of the second embodiment.

Referring to FIG. 11, one-piece housing 202 is fabricated from a sheet 240 of cardboard by cutting, folding, and stapling operations. Sheet 240 comprises inner and outer bottom walls 204 and 208, rear wall 212, and first and second sidewalls 216 and 226. Sheet 240 further comprises cut-lines 242 and 244 that form a rear wall flap 246. Sheet 240 further comprises horizontal fold lines 252 and 254 that allow inner and outer bottom walls 204 and 208 to be folded. Sheet 240 further comprises vertical fold lines 248 and 250 that allow first and second sidewalls 216 and 226 to be folded. Sheet 240 further comprises tabs 256 and 258 extending outward from inner bottom wall 204. Sheet 240 further comprises slots 260 and 262 cut in second sidewall 226 adjacent horizontal fold line 254. When folded, tabs 256 and 258 of inner bottom wall 204 are inserted into slots 260 and 262, respectively, of second sidewall 226. For added stability, inner bottom wall 204 may be stapled to outer bottom wall 208 by staples (not shown). Sheet 240 further comprises openings 224 and 234 cut into first and second sidewalls 216 and 226 to receive spool assembly 44 as described in connection with display box 100 of the first embodiment (FIGS. 2-3). Sheet 240 further comprises flaps 236 and 238 extending outward from first and second sidewalls 216 and 226, respectively, below curved edges 222 and 232, respectively. Sheet 240 further comprises folds lines 264 and 266 so flap 236 may be folded upon inside surface 217 of first sidewall 216 to form smooth leading wall 218. Sheet 240 further comprises folds lines 268 and 270 so flap 238 may be folded upon inside surface 227 of second sidewall 226 to form smooth leading wall 228.

In another embodiment, smooth leading walls 218 and 228 of first and second sidewalls, respectively, could be formed by replacing flaps 236 and 238 with plastic strips attached to leading straight edges 114 and 126 of first and second sidewalls 110 and 122 (FIG. 2) by conventional means such as adhesive or they may be self attaching or clip-on type plastic strips.

Figure 12:
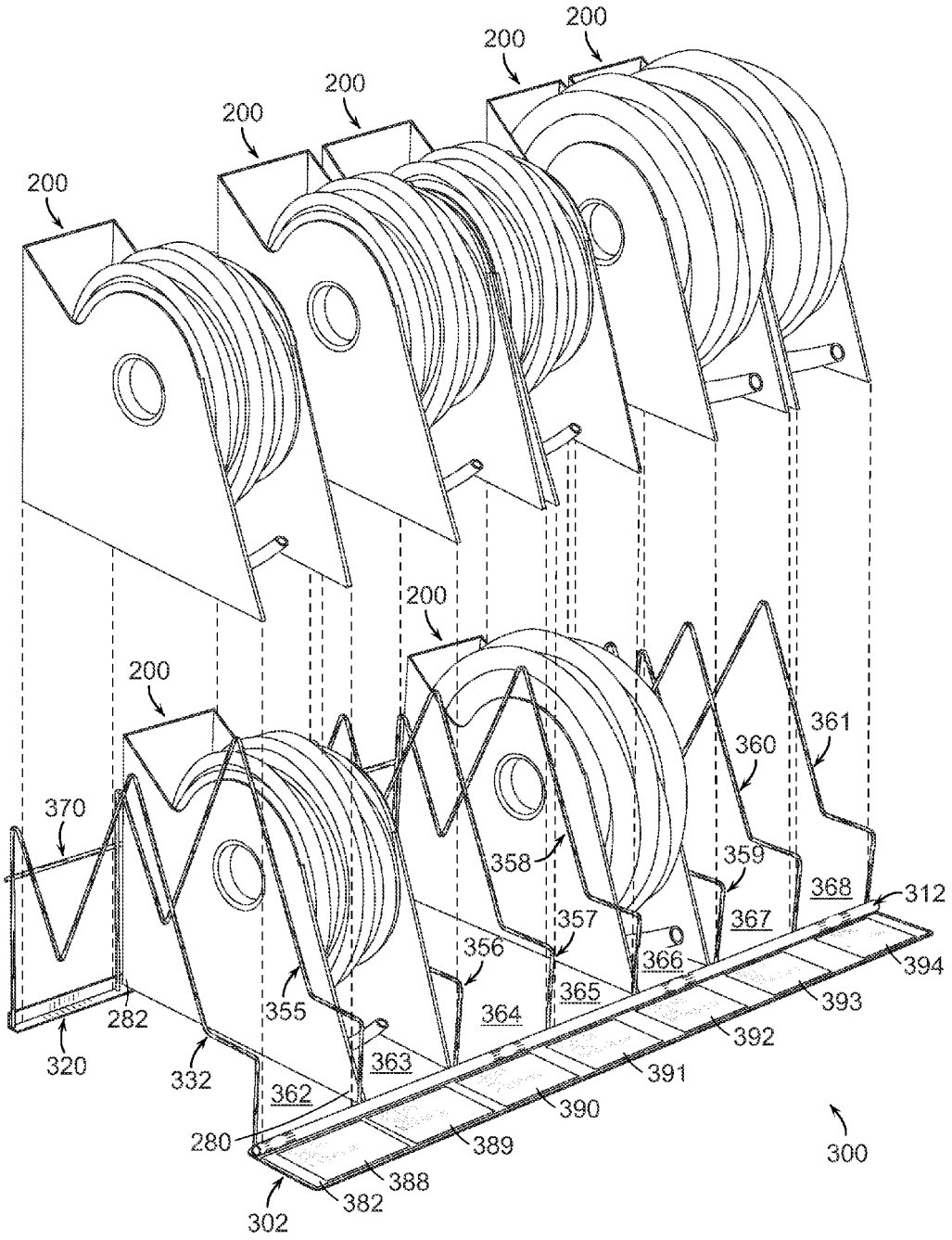
FIG. 12 is a perspective view of a display rack according to the present invention showcasing a plurality of display boxes mounted therein.

Referring to FIG. 12, a display rack 300 according to the present invention is show having a plurality of display boxes 200 (FIG. 7) mounted therein. Display rack 300 allows boxes 200 (and flexible tubing 54) to be effectively showcased on a retail shelf or a floor (not shown) of a store (not shown) for dispensing by a consumer.

With continued reference to FIG. 12, display rack 300 generally comprises a front support member 302, a bumper 312 securely engaged with front support member 302, and a rear support member 320. Display rack 300 further comprises a first open sidewall support member 332 securely engaged with front and rear support members 302 and 320. Display rack 300 further comprises a second open sidewall support member 355 securely engaged with front and rear support members 302 and 320. Display rack 300 further comprises a third open sidewall support member 356 securely engaged with front and rear support members 302 and 320. Display rack 300 further comprises a fourth open sidewall support member 357 securely engaged with front and rear support members 302 and 320. Display rack 300 further comprises a fifth open sidewall support member 358 securely engaged with front and rear support members 302 and 320. Display rack 300 further comprises a sixth open sidewall support member 359 securely engaged with front and rear support members 302 and 320. Display rack 300 further comprises a seventh open sidewall support member 360 securely engaged with front and rear support members 302 and 320. Display rack 300 further comprises an eighth open sidewall support member 361 securely engaged with front and rear support members 302 and 320. Display 300 further comprises a first stall or bin 362 adapted to receive a display box 200 (not shown). Display rack 300 further comprises a second stall or bin 363 adapted to receive a display box 200. Display rack 300 further comprises a third stall or bin 364 adapted to receive a display box 200 (not shown). Display rack 300 further comprises a fourth stall or bin 365 adapted to receive a display box 200 (not shown). Display rack 300 further comprises a fifth stall or bin 366 adapted to receive a display box 200. Display rack 300 further comprises a sixth stall or bin 367 adapted to receive a display box 200 (not shown). Display rack 300 further comprises a seventh stall or bin 368 adapted to receive a display box 200 (not shown). Display rack 300 further comprises a stiffener member 370 securely engaged with open sidewall support members 355, 356, 357, 358, 359, 360, and 361. Display rack 300 further comprises a display sheet 382 securely engaged with front support member 302 and bumper 312 and adapted to provide information about the products contained in display boxes 200 located in stalls 362, 363, 364, 365, 366, 367, and 368.

Figure 13:
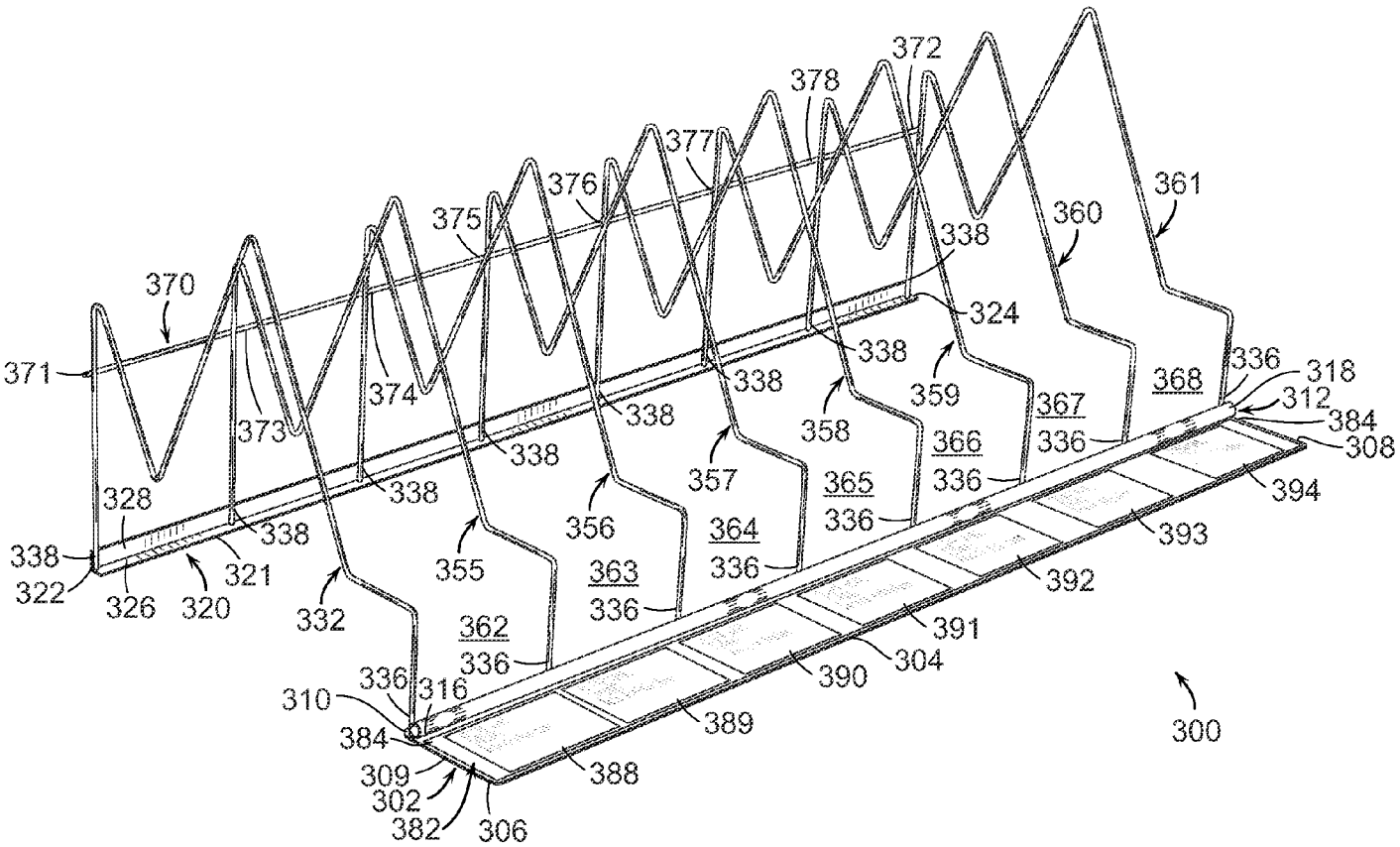
FIG. 13 is a perspective view of the display rack without the display boxes mounted therein.
Figure 14:
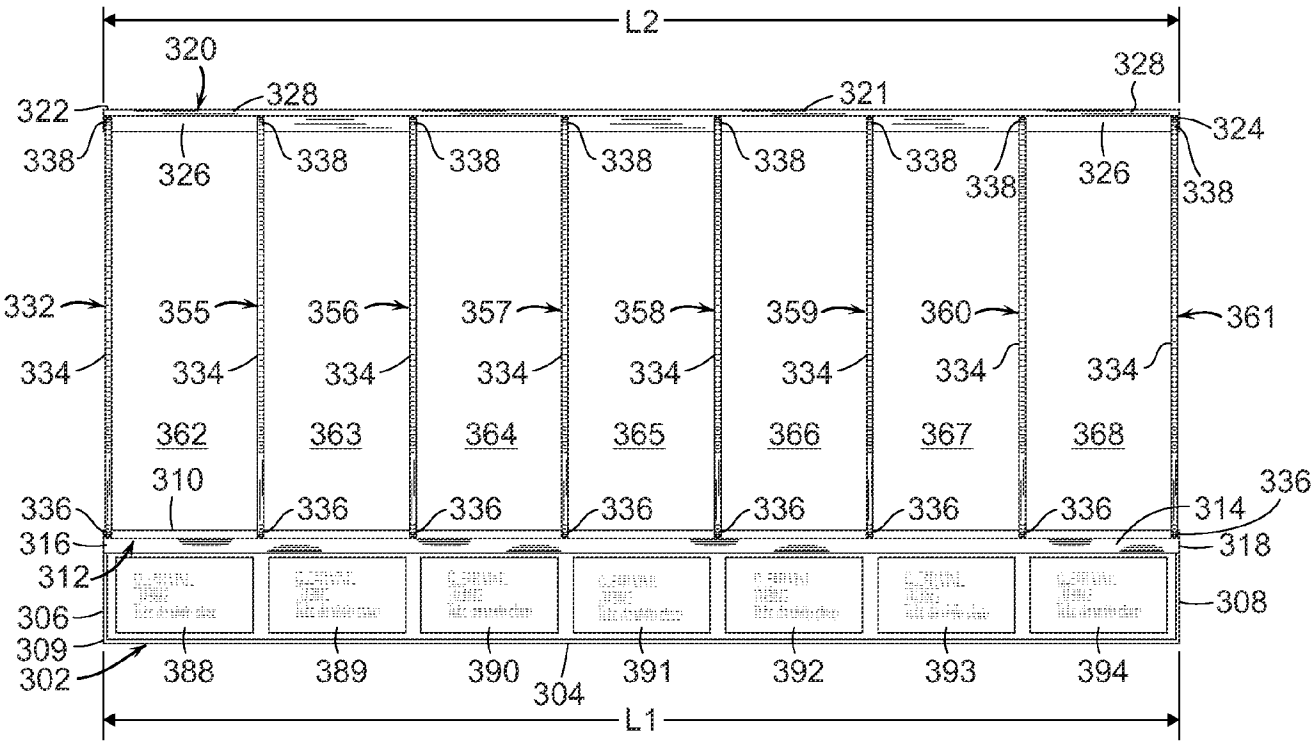
FIG. 14 is a top plan view of the display rack according to the present invention.

Referring to FIGS. 13-14, front support member 302 comprises an elongated body 304 having first and second ends 306 and 308, respectively, a front portion 309, a rear portion 310, and a length L1. Front support member 302 is a flat plate made from steel having a thickness of 1/16 inches and a length L1 equal to forty eight (48) inches. Front support member 302 may be fabricated by conventional sheet metal operation.

Figure 15A:
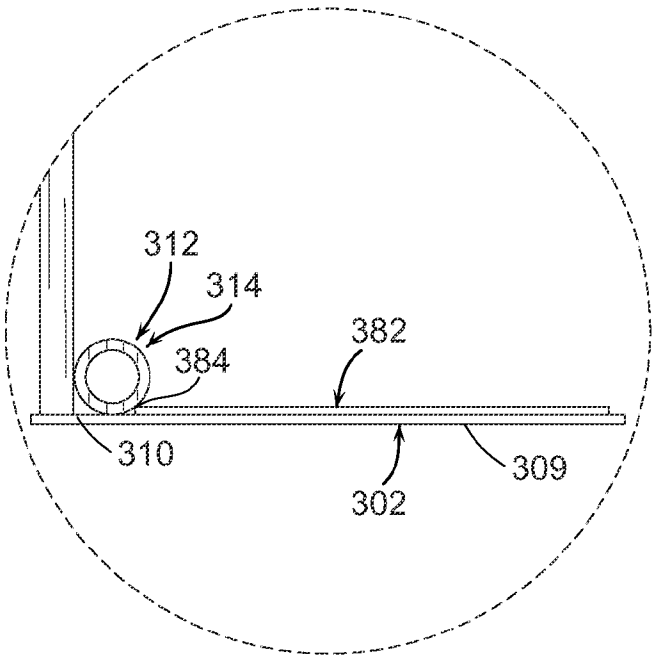
FIG. 15A is an enlarged view of a portion of the display rack shown in FIG. 15.
Figure 15:
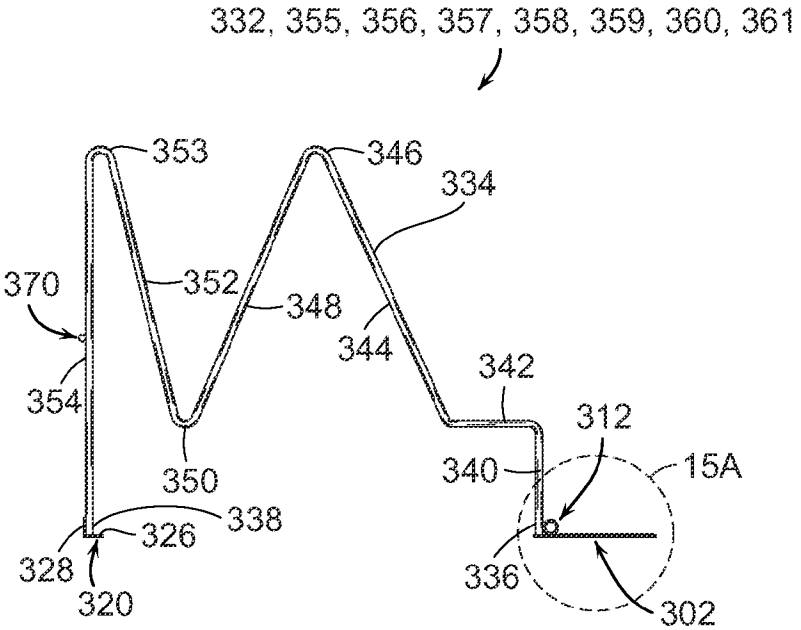
FIG. 15 is a side view of the display rack according to the present invention.

With reference to FIGS. 14-15A, bumper 312 comprises an elongated tubular body 314 having first and second ends 316 and 318. Bumper 312 is secured to rear portion 310 of front support member 302 by conventional welds (not shown). Bumper 312 is preferably made from synthetic polymers and cut by conventional cutting knife operations to a length equal to length L1 of front support member 302. Bumper 312 serves to retain the front portion of display boxes 200 and allows flexible tubing 54 to be dispensed over a smooth rounded surface for easy unwinding from display box 200. Bumper 312 also serves as means of removably securing display sheet 382 to rear portion 310 of front support member 302.

With reference to FIGS. 13-14, rear support member 320 comprises an elongated body having first and second ends 322 and 324. Rear support member 320 further comprises a horizontal portion 326, a vertical portion 328, and a length L2. Rear support member 320 is a right angle flange made from steel having a height of one (1) inch, a width of one (1) inch, a thickness of 1/16 inches, and a length L2 equal to forty eight (48) inches. Rear support member 320 may be fabricated by conventional sheet metal operations.

With reference to FIGS. 13-15, sidewall support members 332 and 355-361 each comprise a rod or wire body 334 having first and second ends 336 and 338. First ends 336 are securely engaged to rear portion 310 of front support member 302 by a conventional weld (not shown). Second ends 338 are securely engaged to horizontal portion 326 of rear support member 320 by a conventional weld (not shown). As best shown by FIG. 15, each of open sidewall support members 332 and 355-361 further comprise a vertical portion 340 extending from first end 336, a horizontal portion 342, an upwardly extended sloped portion 344, a first peak portion 346, a downwardly extended sloped portion 348, a first valley portion 350, an upwardly extended sloped portion 352, a second peak portion 353, and a vertical portion 354 extending to second end 338. Sidewall support members 332 and 355-361 are made from widely available and conventional steel rod or wire having a diameter of 1/4 inches and a length of forty

(40) inches and may be cut and bent to the desire length and shape by conventional cutting and bending operations.

With reference to FIGS. 13-14, first stall or bin 362 is formed by and between open sidewall support members 332 ad 355 and front and rear support members 302 and 320. Front bottom portion 280 of display box 200 (FIG. 7) rests upon rear portion 310 of front support member 302 and against bumper 312. Rear bottom portion 282 of display box 200 rests upon horizontal portion 326 of rear support member 320 and against vertical portion 328 of rear support member 320. The width of stall 362 is designed so that open sidewall support members 332 and 355 apply a slight pressure against sidewalls 216 and 226 of display box 200 to maintain it in fixed lateral position. The length of stall 362 is defined as the distance between vertical portion 328 of rear support member 320 and bumper 312. The length of stall 362 is designed so that display box 200 fits snugly between vertical portion 328 of rear support member 320 and bumper 312 to prevent front and/or back movement of box 200.

With continued reference to FIGS. 13-14, second stall or bin 363 is formed by and between open sidewall support members 355 and 356 and front and rear support members 302 and 320. Front bottom portion 280 of display box 200 (FIG. 7) rests upon rear portion 310 of front support member 302 and against bumper 312. Rear bottom portion 282 of display box 200 rests upon horizontal portion 326 of rear support member 320 and against vertical portion 328 of rear support member 320. The width of stall 363 is designed so that open sidewall support members 355 and 356 apply a slight pressure against sidewalls 216 and 226 of display box 200 to maintain it in fixed lateral position. The length of stall 363 is designed so that display box 200 fits snugly between vertical portion 328 of rear support member 320 and bumper 312 to prevent front and/or back movement of box 200.

With continued reference to FIGS. 13-14, third stall or bin 364 is formed by and between open sidewall support members 356 ad 357 and front and rear support members 302 and 320. Front bottom portion 280 of display box 200 (FIG. 7) rests upon rear portion 310 of front support member 302 and against bumper 312. Rear bottom portion 282 of display box 200 rests upon horizontal portion 326 of rear support member 320 and against vertical portion 328 of rear support member 320. The width of stall 364 is designed so that open sidewall support members 356 and 357 apply a slight pressure against sidewalls 216 and 226 of display box 200 to maintain it in fixed lateral position. The length of stall 364 is designed so that display box 200 fits snugly between vertical portion 328 of rear support member 320 and bumper 312 to prevent front and/or back movement of box 200.

With continued reference to FIGS. 13-14, fourth stall or bin 365 is formed by and between open sidewall support members 357 ad 358 and front and rear support members 302 and 320. Front bottom portion 280 of display box 200 (FIG. 7) rests upon rear portion 310 of front support member 302 and against bumper 312. Rear bottom portion 282 of display box 200 rests upon horizontal portion 326 of rear support member 320 and against vertical portion 328 of rear support member 320. The width of stall 365 is designed so that open sidewall support members 357 and 358 apply a slight pressure against sidewalls 216 and 226 of display box 200 to maintain it in fixed lateral position. The length of stall 365 is designed so that display box 200 fits snugly between vertical portion 328 of rear support member 320 and bumper 312 to prevent front and/or back movement of box 200.

With continued reference to FIGS. 13-14, fifth stall or bin 366 is formed by and between open sidewall support members 358 ad 359 and front and rear support members 302 and 320. Front bottom portion 280 of display box 200 (FIG. 7) rests upon rear portion 310 of front support member 302 and against bumper 312. Rear bottom portion 282 of display box 200 rests upon horizontal portion 326 of rear support member 320 and against vertical portion 328 of rear support member 320. The width of stall 366 is designed so that open sidewall support members 358 and 359 apply a slight pressure against sidewalls 216 and 226 of display box 200 to maintain it in fixed lateral position. The length of stall 366 is designed so that display box 200 fits snugly between vertical portion 328 of rear support member 320 and bumper 312 to prevent front and/or back movement of box 200.

With continued reference to FIGS. 13-14, sixth stall or bin 367 is formed by and between open sidewall support members 359 ad 360 and front and rear support members 302 and 320. Front bottom portion 280 of display box 200 (FIG. 7) rests upon rear portion 310 of front support member 302 and against bumper 312. Rear bottom portion 282 of display box 200 rests upon horizontal portion 326 of rear support member 320 and against vertical portion 328 of rear support member 320. The width of stall 367 is designed so that open sidewall support members 359 and 360 apply a slight pressure against sidewalls 216 and 226 of display box 200 to maintain it in fixed lateral position. The length of stall 367 is designed so that display box 200 fits snugly between vertical portion 328 of rear support member 320 and bumper 312 to prevent front and/or back movement of box 200.

With continued reference to FIGS. 13-14, seventh stall or bin 368 is formed by and between open sidewall support members 360 and 361 and front and rear support members 302 and 320. Front bottom portion 280 of display box 200 (FIG. 7) rests upon rear portion 310 of front support member 302 and against bumper 312. Rear bottom portion 282 of display box 200 rests upon horizontal portion 326 of rear support member 320 and against vertical portion 328 of rear support member 320. The width of stall 368 is designed so that open sidewall support members 360 and 361 apply a slight pressure against sidewalls 216 and 226 of display box 200 to maintain it in fixed lateral position. The length of stall 368 is designed so that display box 200 fits snugly between vertical portion 328 of rear support member 320 and bumper 312 to prevent front and/or back movement of box 200.

With reference to FIG. 13, stiffener member 370 comprises first and second ends 371 and 372 secured to open sidewall support members 332 and 361, respectively, by conventional welds (not shown). Stiffener member 370 further comprises an inner portion 373 secured to open sidewall support member 355 by a conventional weld (not shown). Stiffener member 370 further comprises an inner portion 374 secured to open sidewall support member 356 by a conventional weld (not shown). Stiffener member 370 further comprises an inner portion 375 secured to open sidewall support member 357 by a conventional weld (not shown). Stiffener member 370 further comprises an inner portion 376 secured to open sidewall support member 358 by a conventional weld (not shown). Stiffener member 370 further comprises an inner portion 377 secured to open sidewall support member 359 by a conventional weld (not shown). Stiffener member 370 further comprises an inner portion 378 secured to open sidewall support member 360 by a conventional weld (not shown). Stiffener member 370 is made from widely available and conventional steel rod or wire having a diameter of ¼ inches and a length of forty (48) inches and may be cut to the desire length by conventional cutting operations.

With continued reference to FIGS. 13-15A, display sheet 382 is a single continuous sheet of paper sized to fit on front portion 309 of front support member 302. As best shown by FIG. 15A, display sheet 382 comprises a rear edge 384 removably secured and pinched in place between bumper 312 and rear portion 310 of front support member 302. Display sheet 312 further comprises a first information portion 388 aligned with first stall or bin 362. First information portion 388 comprises information about the product contained in first stall 362. For example, first information portion 388 may display the words "¼ inch clear vinyl tubing." Display sheet 312 further comprises a second information portion 389 aligned with second stall or bin 363. Second information portion 389 comprises information about the product contained in second stall 363. For example, second information portion 389 may display the words "⅜ inch clear vinyl tubing." Display sheet 312 further comprises a third information portion 390 aligned with third stall or bin 364. Third information portion 390 comprises information about the product contained in third stall 364. For example, third information portion 390 may display the words "½ inch clear vinyl tubing." Display sheet 312 further comprises a fourth information portion 391 aligned with fourth stall or bin 365. Fourth information portion 391 comprises information about the product contained in fourth stall 365. For example, fourth information portion 391 may display the words "¾ inch vinyl tubing." Display sheet 312 further comprises a fifth information portion 392 aligned with fifth stall or bin 366. Fifth information portion 392 comprises information about the product contained in fifth stall 366. For example, fifth information portion 392 may display the words "¼ inch rubber tubing." Display sheet 312 further comprises a sixth information portion 393 aligned with sixth stall or bin 367. Sixth information portion 393 comprises information about the product contained in sixth stall 367. For example, sixth information portion 393 may display the words "⅜ inch rubber tubing." Display sheet 312 further comprises a seventh information portion 394 aligned with sixth stall or bin 368. Seventh information portion 394 comprises information about the product contained in seventh stall 368. For example, seventh information portion 394 may display the words "½ inch rubber tubing."

Display rack 300 has been described with seven (7) stalls or bins each adapted to removably secure a display box 200. Display rack 300 may be displayed with more or less than seven (7) stalls or bins. Display rack has been described with reference to seven (7) stalls having the same width. In other embodiments, the stalls may have different widths. Display rack 300 has been described in connection with display boxes 200 which store and dispense flexible tubing. Display boxes 200 may store and dispense articles other than flexible tubing such as different sized ropes.

While particular embodiments of the invention have been shown and described, it will be obvious to those skilled in the art that changes and modifications may be made without departing from the scope of the claimed invention.

What is claimed:

1. A display rack mountable for showcasing first, second, and third display boxes, each of the first, second, and third display boxes having front and rear portions and front and rear bottom portions, the display rack comprising:

a front support member;

a rear support member;

a first open sidewall support member comprising a first end engaged with said front support member and a second end engaged with said rear support member;

a second open sidewall support member comprising a first end engaged with said front support member and a second end engaged with said rear support member;

a third open sidewall support member comprising a first end engaged with said front support member and a second end engaged with said rear support member;

a first stall formed between said first and second sidewall support members; said first stall being adapted to receive the first display box; said front support member being adapted to support the front bottom portion of the first display box; the rear support member being adapted to support the rear bottom portion of the first display box; and a second stall formed between said second and third sidewall support members; said second stall being adapted to receive the second display box; said front support member being adapted to support the front bottom portion of the second display box; the rear support member being adapted to support the rear bottom portion of the second display box.

2. The display rack of claim 1, further comprising a stiffener member engaged with said first, second, and third open sidewall support members and crossing said first and second stalls.

3. The display rack of claim 2, further comprising a bumper engaged with said front support member to prevent forward movement of the first display box and the second display box.

4. The display rack of claim 3, further comprising a display sheet engaged with said front support member.

5. The display rack of claim 4, wherein said front support member comprises an elongated body portion having a length L1.

6. The display rack of claim 5, wherein said rear support member comprises an elongated body portion having a length L2; said length L1 being substantially equal to said length L2.

7. The display rack of claim 6, wherein said front support member comprises front and rear portions.

8. The display rack of claim 7, wherein said bumper being engaged with said rear portion of said front support member.

9. The display rack of claim 8, wherein said display sheet comprises a rear edge removably engaged between said bumper and said rear portion of said front support member.

10. The display rack of claim 9, wherein said rear support member comprises a substantially horizontal portion and a substantially vertical portion.

11. The display rack of claim 10, further comprising a fourth open sidewall support member comprising a first end engaged with said front support member and a second end engaged with said rear support member.

12. The display rack of claim 10, further comprising a third stall formed between said third and fourth open sidewall support members; said third stall being adapted to receive the third display box; said front support member being adapted to support the front bottom portion of a third display box; the rear support member being adapted to support the rear bottom portion of the third display box.

13. The display rack of claim 12, wherein said rear portion of said front support member is adapted to support the front bottom portion of the first, second, and third display boxes; said horizontal portion of said rear support member is adapted to support the rear bottom portion of the first, second, and third display boxes.

14. The display rack of claim 13, wherein said stiffener member is engaged with said fourth open sidewall support member and crossing said third stall.

15. The display rack of claim 14, wherein said bumper is an elongated metal tube engaged with said rear portion of said front support member.

* * * * *